US006588056B2

(12) United States Patent
Holbrook et al.

(10) Patent No.: US 6,588,056 B2
(45) Date of Patent: Jul. 8, 2003

(54) WEB TRIM COLLECTION SYSTEM

(75) Inventors: Russell W. Holbrook, Southbury, CT (US); Edward M. Ifkovits, New Fairfield, CT (US); Douglas G. Long, Naugatuck, CT (US); Daniel J. Williams, Woodbury, CT (US)

(73) Assignee: Pitney Bowes Inc., Stamford, CT (US)

( * ) Notice: Subject to any disclaimer, the term of this patent is extended or adjusted under 35 U.S.C. 154(b) by 0 days.

(21) Appl. No.: 09/971,466

(22) Filed: Oct. 5, 2001

(65) Prior Publication Data

US 2003/0066157 A1 Apr. 10, 2003

(51) Int. Cl.[7] ..... A47L 5/38

(52) U.S. Cl. ..... 15/352; 15/301; 15/319; 406/159; 406/183

(58) Field of Search ..... 15/301, 347, 352, 15/319; 55/356, 385.1; 406/2, 43, 99, 139, 156, 159, 183; 141/65, 67

(56) References Cited

U.S. PATENT DOCUMENTS 2,878,508 A * 3/1959 Sedgwick et al. ..... 15/352
3,141,705 A * 7/1964 Valentine ..... 406/128
3,175,668 A * 3/1965 Stoltzfus ..... 406/159
3,257,150 A * 6/1966 Walsh ..... 406/156
3,486,309 A * 12/1969 Wild ..... 15/301
5,083,704 A * 1/1992 Rounthwaite ..... 15/319
5,226,213 A * 7/1993 Lewis et al. ..... 406/159
5,284,388 A * 2/1994 Volk et al. ..... 366/141
5,322,232 A * 6/1994 Freeman et al. ..... 242/471
5,423,170 A * 6/1995 Dammann et al. ..... 15/301
6,154,919 A * 12/2000 Hetko ..... 15/352

* cited by examiner

*Primary Examiner*—Theresa T. Snider
(74) *Attorney, Agent, or Firm*—Michael J. Cummings; Charles R. Malandra, Jr.; Angelo N. Chaclas

(57) ABSTRACT

A web trim collection system having an air pressure system to move web trim. A divert bin operable in a first position to allow the web trim to be deposited in a collection bin. The divert bin is also operable in a second position to intercept the web trim, so as to allow the collection bin to be removed from the collection system while the collection system continues to collect trim.

21 Claims, 8 Drawing Sheets

WEB TRIM COLLECTION SYSTEM

FIELD OF THE INVENTION

The present invention is related generally to web handling apparatus and more particularly, to the collecting and removing of web trim.

BACKGROUND OF THE INVENTION

Some printers and document handling systems use one or more tractor feeders to move a continuous paper web. In the tractor feeders, sprockets are generally use to drive strips at the outer edges of a paper web. The strips are often trimmed or stripped away in a post-processing step. These paper strips, or web trim, are thrown out or recycled. In the stripping processing, paper dust is usually generated as the strips are trimmed. The web trim and paper dust must be somehow collected and discarded.

U.S. Pat. No. 5,322,232 (Freeman et al.) discloses a trim removal system, wherein the trim is collected in a receiving funnel and moved into a collection drum by vacuum fans. The web trim is wound into a bale and paper dust is trapped in a dust trap for disposal. While the bale could simplify the disposal of the web trim, the remove system must be equipped with a rewinding mechanism for winding the bale. This increases the complexity of the design and the manufacturing and maintenance costs. Furthermore, when the bale is removed from the trim removal system, the rewinding mechanism must be stopped.

Thus, it is advantageous and desirable to provide a trim removal system with a simplified design, wherein the collected trim can be removed from the system while the system continues the trim collection operation.

SUMMARY OF THE INVENTION

It is a primary object of the present invention to provide a web trim collection system, wherein the trim can be collected without interruption even when the collected trim is removed from the system for disposal. This object can be achieved by using a collection bin to collect the trim under normal operation, and a divert bin to receive the trim when the collection bin is removed from the collection system for changeovers of the collection bin.

According to the first aspect of the present invention, a web trim collection system connected to a trim receiver which receives web trim, said system comprising:

- a channel having a first end and a second end, the first end communicating with the trim receiver;
- a divert bin having an inlet in communication with the second end of the channel, wherein the divert bin further has a collection region, an aperture, and means for operating the divert bin between a first position and a second position,
- a collection bin having an inlet communicable with the aperture of the divert bin when the divert bin is operated in a first position so as to allow the web trim to pass through the divert bin and to be deposited into the collection bin, and when the divert bin is operated in the second position, the collection region of the divert bin collects the web trim received through the receiving end of the divert bin, thereby preventing the web trim from being deposited into the collection bin and allowing the collection bin to be removed from said web trim collection system for changeovers of the collection bin while said collection system continues to collect web trim; and

- a trim moving mechanism for moving the web trim from the trim receiver into the divert bin or further into the collection bin.

Preferably, when the divert bin is operated in the first position, the collection region is so positioned that the web trim collected in the collection region can be deposited into the inlet of the collection bin through the aperture of the divert bin.

Preferably, the trim moving mechanism comprises an air pressure system for creating an air flow from the trim receiver through the channel, wherein the air pressure system can be one or more blowing fans or vacuum/motor units.

Preferably, the web collection system comprises a sensing mechanism to sense the level of the web trim deposited in the collection bin when the divert bin is operated in the first position, and the system further comprises a warning device which is turned on when the sensing mechanism senses that the level of the web trim deposited in the collection bin has reached a predetermined level. Preferably, the sensing mechanism is capable of causing the system to shut down when the collection bin is filled.

According to the present invention, the web trim collection system comprises one or more air outlets for discharging air brought in by the air flow from the trim collection system into an area surrounding the web trim collection system through one or more air filters.

According to the present invention, the web trim collection system comprises one or more flapper doors communicable with the air outlets and the collection bin for allowing the air in the collection bin to be discharged from the air outlet through the trapper doors when the divert bin is operated in the first position, wherein the trapper doors are closed when the divert bin is operated in the second position so as to prevent the air in the collection bin from entering the air outlets.

According to the present invention, the collection system can be manually turned on or off using a control switch on the collection system or remotely turned on or off by an external device or console through an interface.

According to the present invention, the collection system comprises a platform having a seal, wherein the platform can be operated in a first platform position in contact with the collection bin so as to provide an air seal to the collection bin with the seal when the divert bin is operated in the first position, and the platform can be operated in a second platform position separate from the collection bin so as to allow the collection bin to be removed from the web trim collection system. The collection system further comprises a sensing mechanism to sense the position of the divert bin so as to prevent the platform to be operated in the second platform position when the divert bin is operated in the first position.

According to the present invention, a control lever is used for manually changing the operating position of the divert bin.

The present invention will become apparent upon reading the description taken in conjunction with FIGS. 1 to 5.

DETAILED DESCRIPTION OF THE INVENTION

Figure 1:
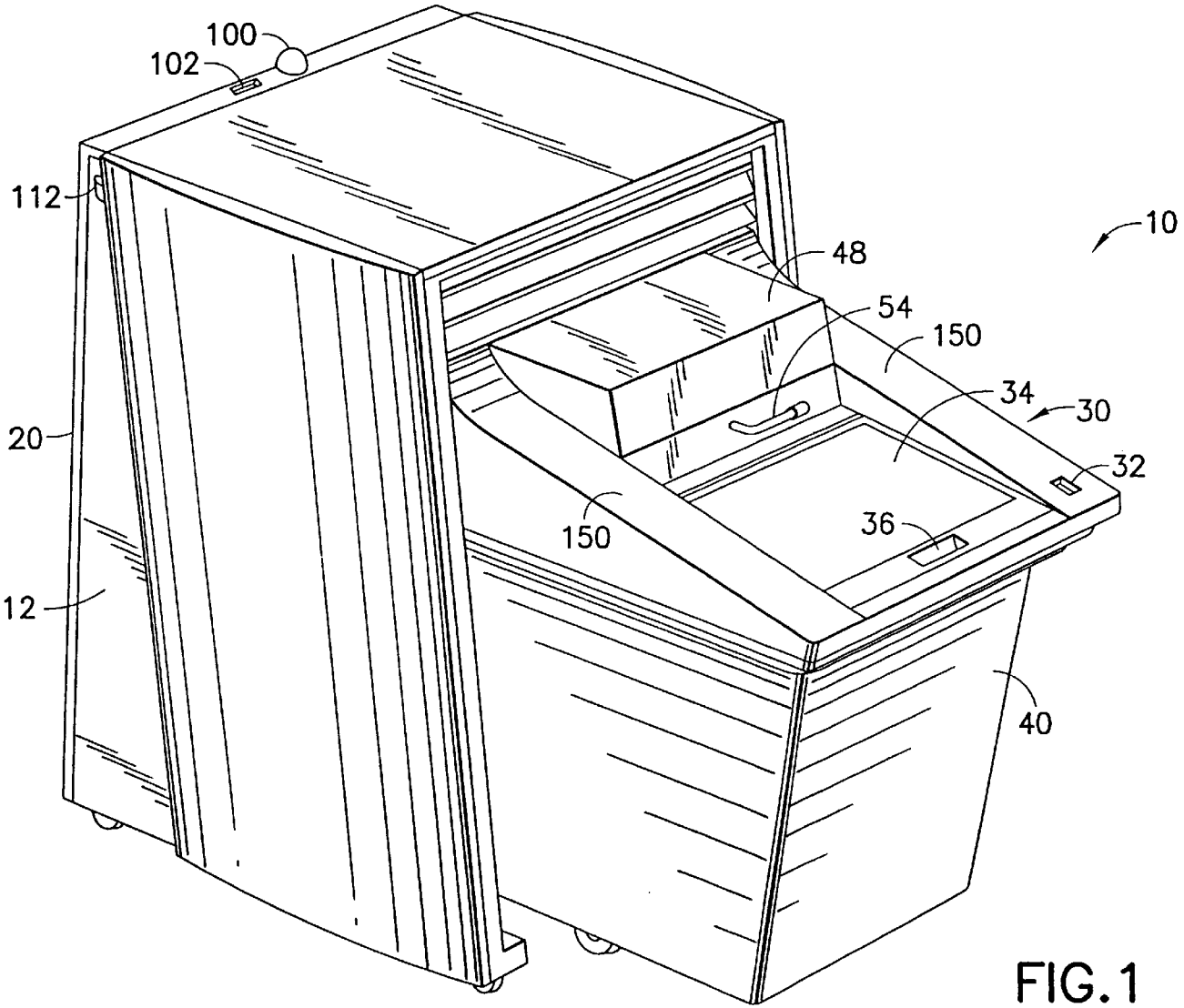
FIG. 1 is a perspective view showing the web trim collection system, according to the present invention.

As shown in FIG. 1, the web trim collection system 10, according to the present invention, has a main body 12, operatively connected to a platform 30 which is positioned on top of a collection bin 40. The platform 30, under the control of a control switch 32, can be lowered to make contact with the collection bin 40 in a normal trim-collecting operation, and raised to allow the collection bin 40 to be removed from the collection system 10 for changeovers of the collection bin 40. Preferably, the platform 30 has a tamping door/window 34 to allow visual monitoring of the scrap level. The tamping door 34 can be opened using a door handle 36 for tamping the scrap inside the collection bin 40, if necessary or so desired. As shown in FIG. 1, the platform 30 has a divert bin housing 48, which houses a divert bin 50 (see FIGS. 2*a*–4*b*), and a control lever 58 for controlling the position of the divert bin 50. The platform 30 also has two side-compartments 150 to allow air to flow therethrough (see FIGS. 4*a*–4*b*). Preferably, the collection system 10 has a warning device, such as a warning light 100 or an audible device 102 to indicate that level of the scrap in the collection bin 10 has reached a predetermined level and that the scrap should be tamped or the collection bin 40 emptied. A manual control switch 112 can be used to manually turn on or turn off the collection system 10.

Figure 2A:
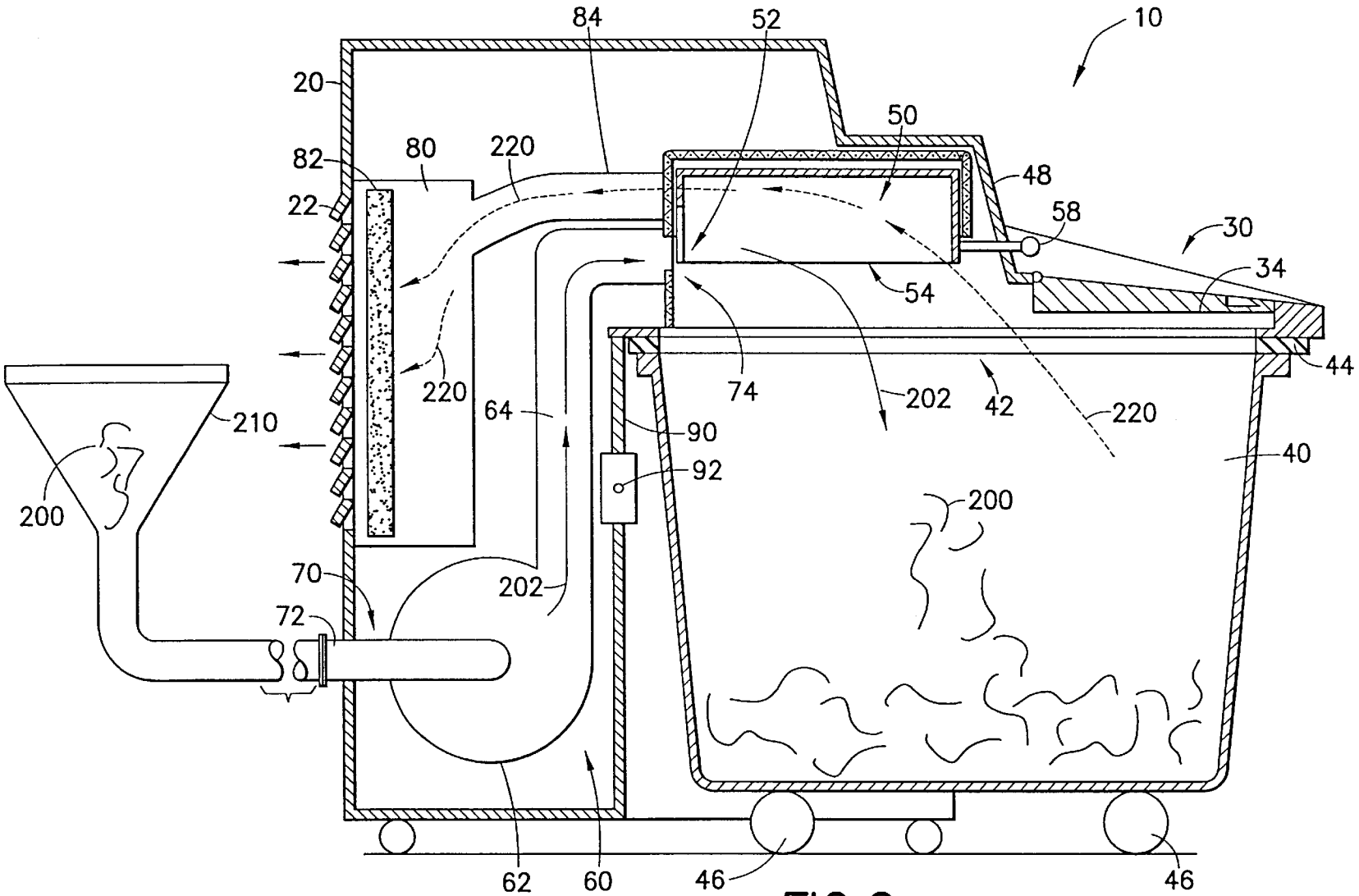
FIG. 2*a* is a diagrammatic representation illustrating the operation of the web trim collection system, according to the present invention, when the trim is deposited into a collection bin.

FIG. 2*a* illustrates the normal operation of the web trim collection system, when the trim is deposited into the collection bin 40. As shown, the collection system 10 is connected to a trim receiver 210, which receives web trim 200 from a web handling system (not shown). The web handling system is not part of the invention. The collection system 10 has a channel 70 to channel the web trim 200 from an inlet 72 to an outlet 74 for discharging the web trim into a receiving end 52 of the divert bin 50. As shown, the collection system 10 has an air pressure system 60 to create a pressure difference between the trim receiver 210 and the channel 70 for moving the trim 200 from the trim receiver 210 to the outlet 74. Under normal operations, the divert bin 50 is operated at a first position (see FIG. 4*a*) so as to allow the web trim 200 to be deposited into the collection bin 40 through an aperture 54 of the divert bin 50. The movement of the trim 200 is symbolically represented by arrow 202. Preferably, the air pressure system 60 includes a blowing fan or vacuum/motor unit 62 to cause the web trim 200 to pass through the divert bin 50 and to be deposited into the collection bin 40. It is preferable to connect the vacuum/motor unit 62 to a muffler 64 to reduce the noise generated by the vacuum/motor unit 62. As shown in FIG. 2*a,* the collection system 10 has a lifting mechanism 90 operatively connection to an actuator 92, which is controlled by a control switch 32 (FIG. 1). When the actuator 92 is actuated, the lifting mechanism 90 can lower the platform 30 to make contact with the collection bin 40 for providing an air seal to the collection bin 40 through a seal 44. Also shown in FIG. 2*a* is a filtration chamber 80 having one or more air filters 82 to remove paper dust from the air so that the air moves out into the environment as clean air. As shown, the air moves from the collection bin 40 through one or more exhausts 84 to one or more air outlets 22 in a rear panel 20. The passageway of the air is symbolically represented by arrow 220.

Figure 2B:
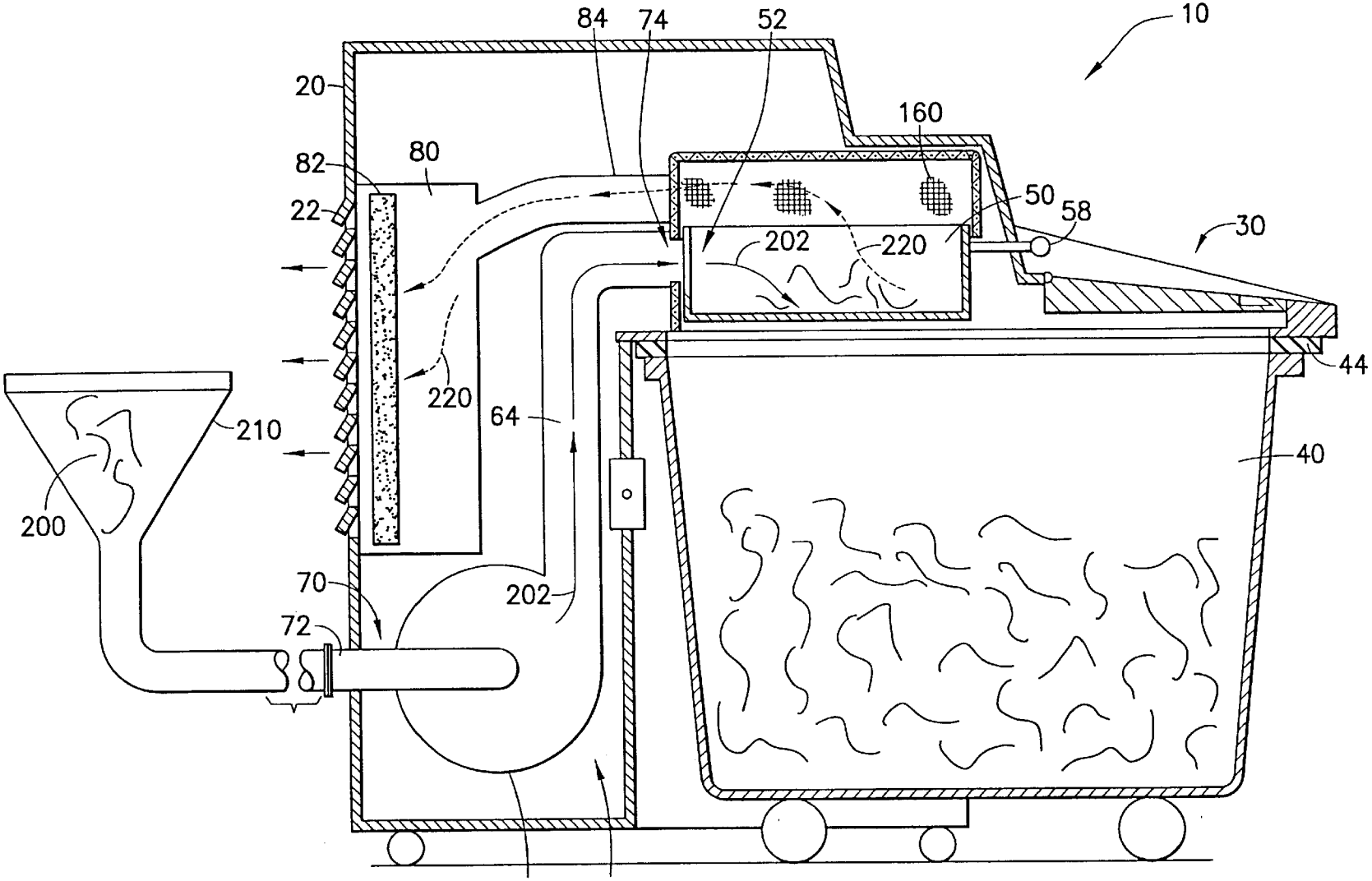
FIG. 2*b* is a diagrammatic representation illustrating the operation of the web trim collection system, according to the present invention, when the trim is temporarily deposited into a divert bin.
Figure 2C:
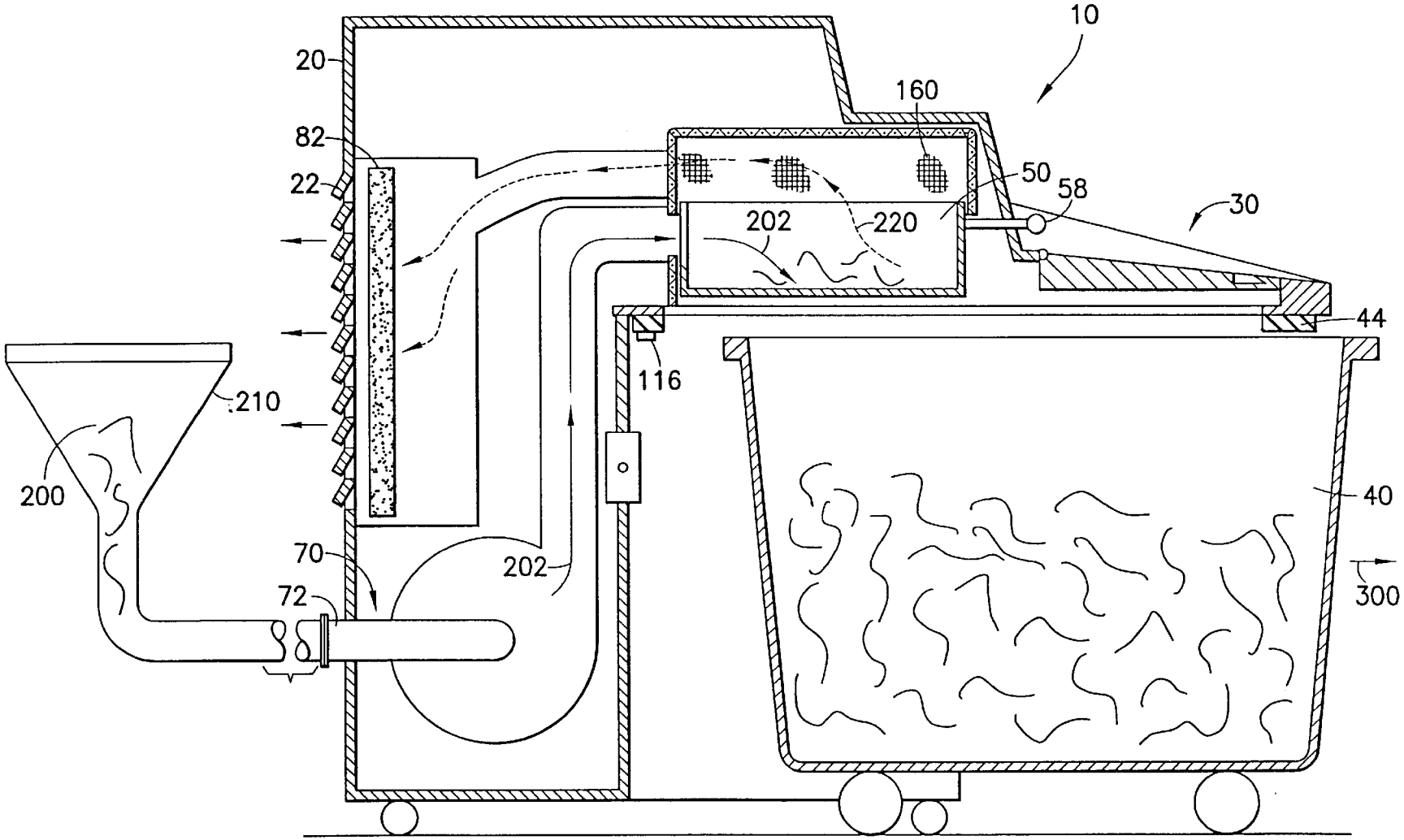
FIG. 2*c* is a diagrammatic representation illustrating the removal of the collection bin from the web trim collection system, while the trim collection system continues to collect trim.
Figure 3:
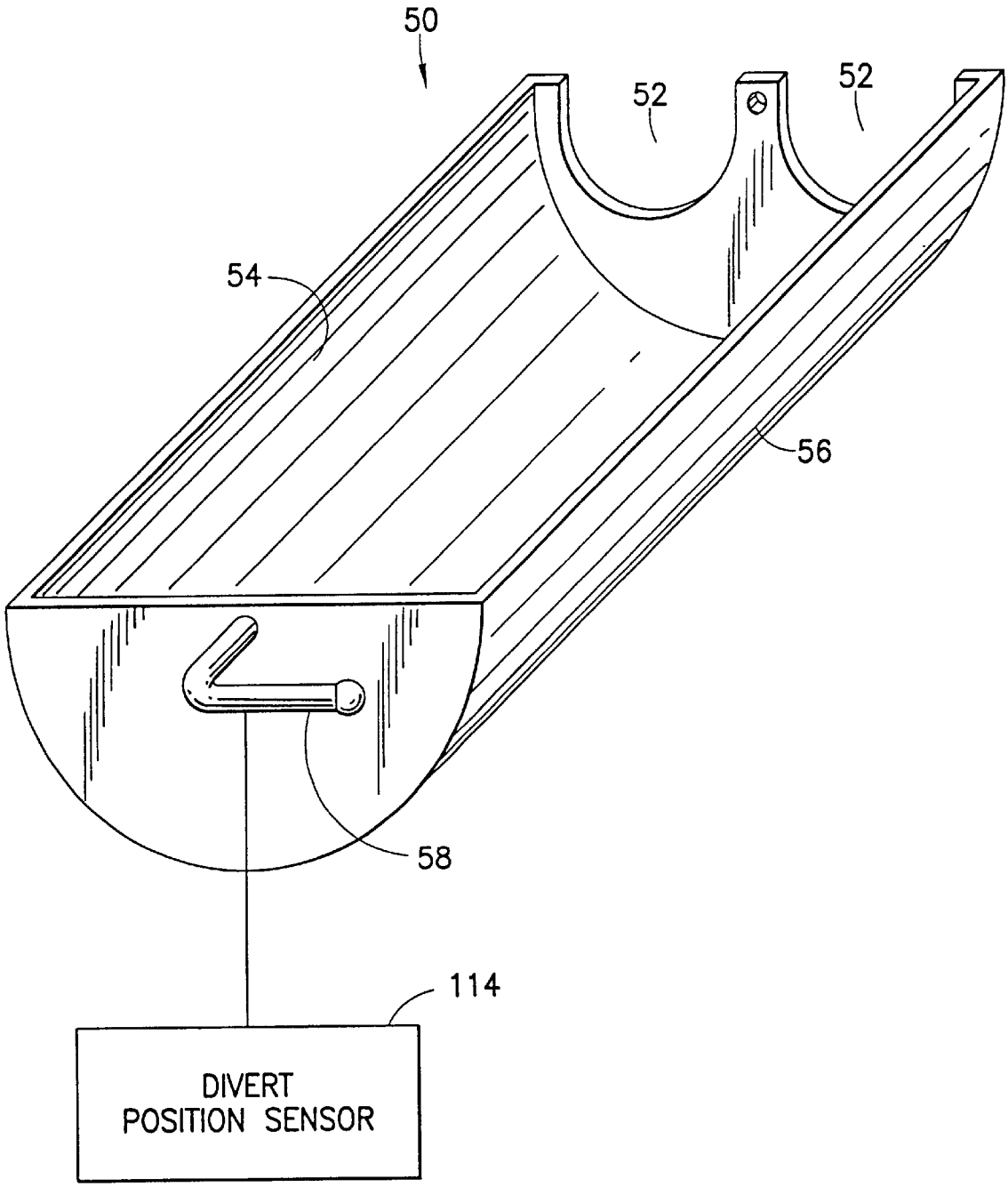
FIG. 3 is a diagrammatic representation illustrating the preferred embodiment of the divert bin, according to the present invention.

FIG. 2*b* illustrates the operation of the web trim collection system, when the divert bin 50 is operated in a second position. As shown, the web trim is collected in the collection region 56 (as seen in FIG. 3) of the divert bin 50, instead of the collection bin 40. The air within the collection system 10 is moved from the divert bin 50 through an upper screen 160. The air is filtered by the air filters 82 before being discharged from the rear panel 20. When the divert bin 50 is operated in the second position, the collection bin 40 can be removed from the collection system 10 (as indicated by arrow 300 in FIG. 2C) for changeovers of the collection bin 40, while the collection system 10 continues to collect the trim. However, the platform 30 must be raised by the lifting mechanism 90 so as to separate the platform 30 from the collection bin 40, as shown in FIG. 2*c.* Furthermore, it is preferable to have a collection bin sensor 116 to sense the presence of the collection bin 40 such that when the collection bin 40 is not properly placed under the platform 30 or when the platform 30 is not lowered to provide an air seal to the collection bin 40, the collection bin sensor 116 discontinues the trim collection operation if the divert bin 50 is operated in the first position.

FIG. 3 illustrates the preferred embodiment of the divert bin 50, according to the present invention. As shown, the divert bin 50 is made of a cylindrical drum having a section of the drum section cut out to provide the aperture 54. The remaining part of the drum serves as the collection region 56. On one end of the divert bin 50, one or more cutout regions are used as the receiving end 52 for receiving the web trim from the outlet 74 of the channel 70. The other end of the divert bin 50 is operatively connected to the control lever 58 so that the divert bin can be rotated to the first or second position. It is preferred that a divert position sensor 114 is used to sense the position of the divert bin 50 so that the platform 30 can be raised to separate the platform 30 from the collection bin 40 only when the divert bin 50 is operated in the second position. The divert position sensor 114 can be an optical sensor, a proximity sensor, a contact switch or the like.

Figure 4A:
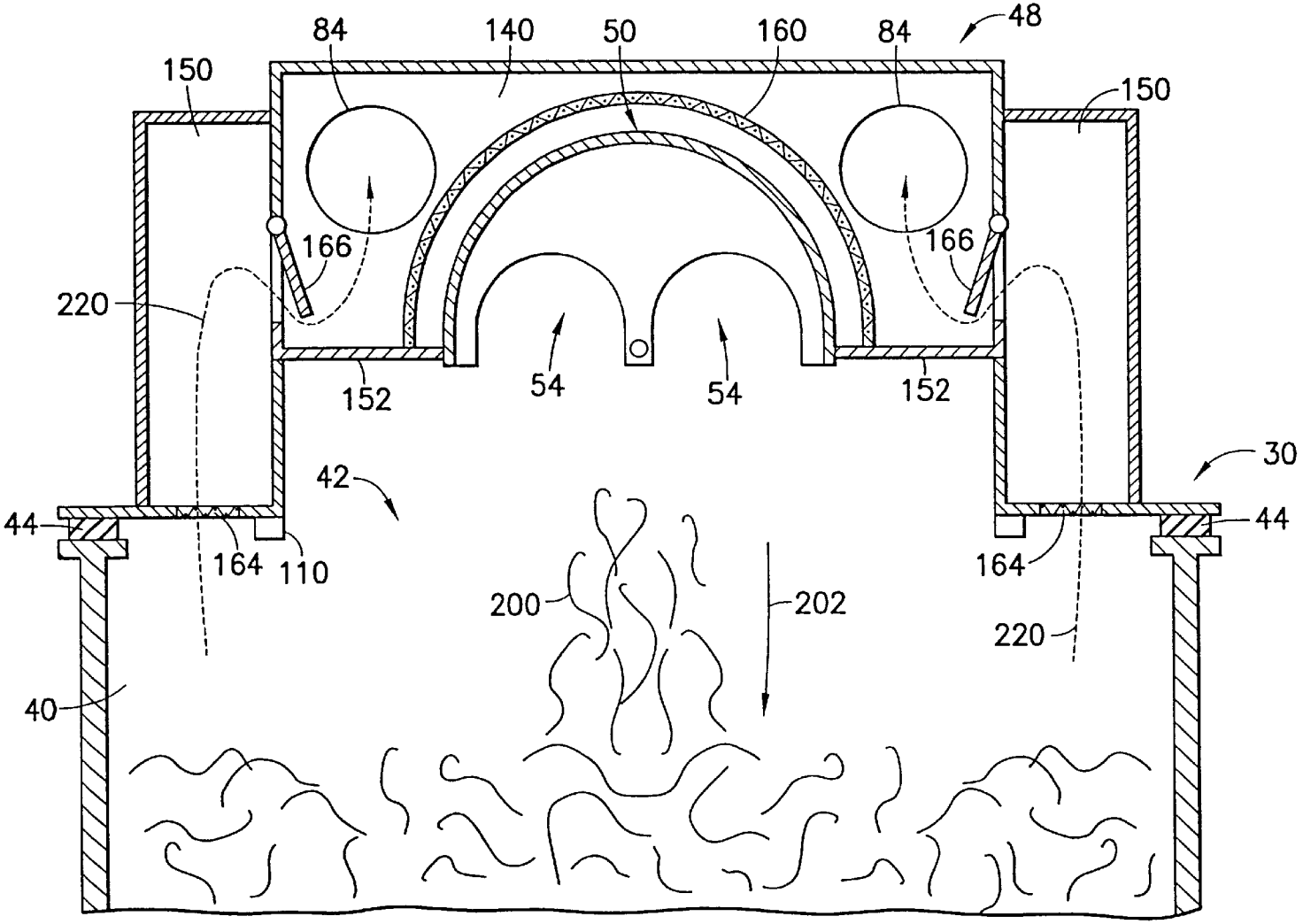
FIG. 4*a* is a diagrammatic representation illustrating the divert bin operated at a first position to allow the trim to be deposited into the collection bin and air in the collection bin to move out into the environment as clean air.

FIG. 4*a* illustrates the divert bin 50 being operated at the first position to allow the web trim 200 to be deposited into the collection bin 40. As shown in FIG. 4*a,* the housing 48 has a center compartment 140 defined by the partitioning walls 152, the divert bin 50 and two side-compartments 150 of the platform 30 (see FIG. 1). In each side-compartment 150, a lower screen 164 is provided to allow air from the collection bin 40 to enter the respective side-compartment 150, and a flapper door 166 is provided to allow the air in the respective side compartment 150 to enter the center compartment 140. When the divert bin 50 is operated in the first position, as shown, the air pressure system 60 moves the air, along with the web trim 200 into the collection bin 40.

Figure 4B:
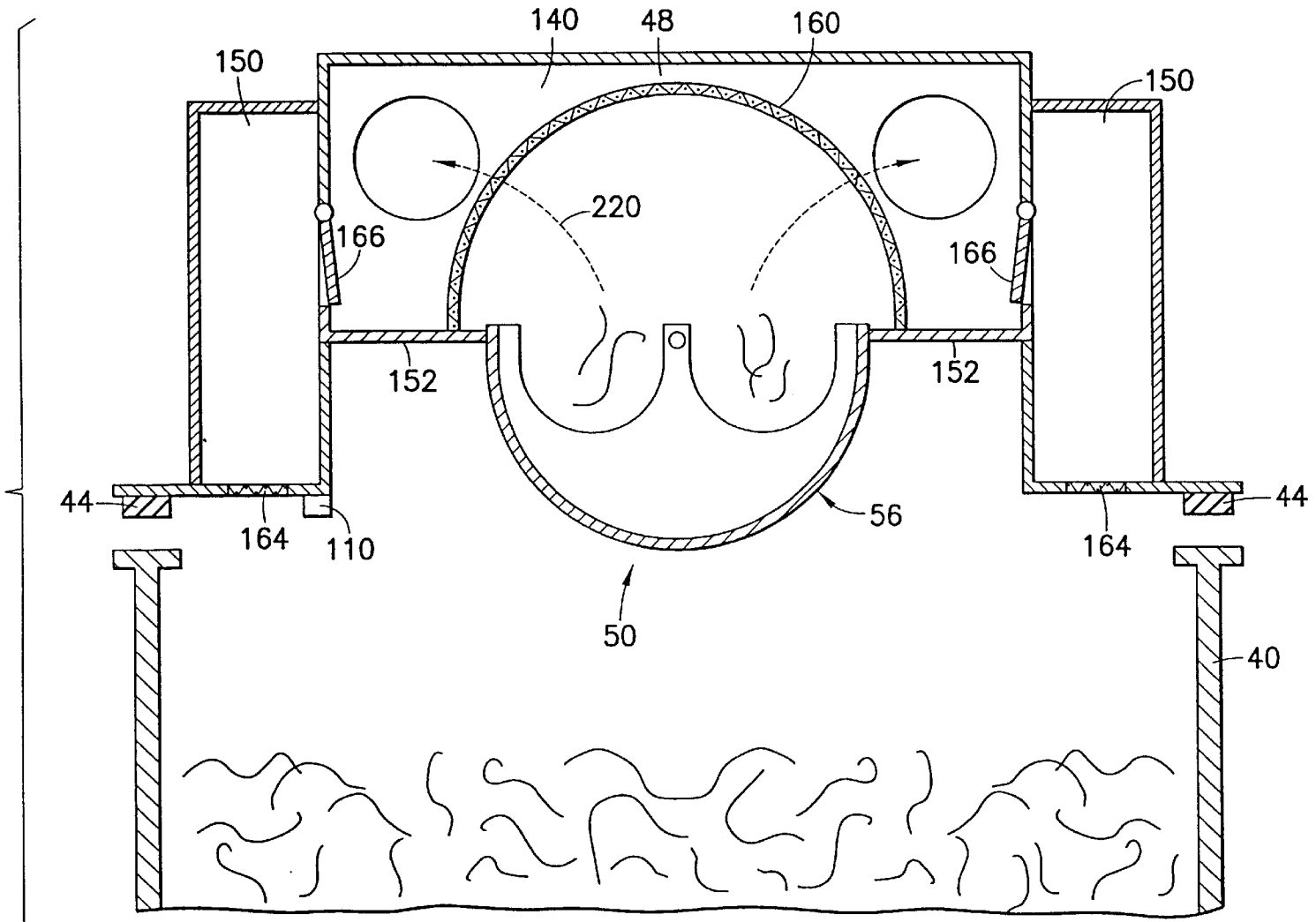
FIG. 4*b* is a diagrammatic representation illustrating the divert bin operated at a second position to allow the trim to be deposited into the collection region of the divert bin.

Thus, the air pressure in the collection bin 40 is higher than that in the center compartment 140. The air in the collection bin 40 is drawn through the lower screen 164 and flapper door 166 in each side-compartment 150 to the exhausts 84. When the divert bin 50 is operated in the second position, as shown in FIG. 4*b,* the air and the web trim 200 moved by the air pressure system 60 are prevented from reaching the collection bin 40 by the collection region 56 of the divert bin 50. While the trim 200 remains in the collection region 56, the air is drawn through the upper screen 160 to the exhausts 84. Because the air pressure in the center compartment 140 is higher than that in the side-compartments 150, the flapper doors 166 are closed. As such, the platform 30, along with the housing 48, can be separated from the collection bin 40, while the collection system 10 continues to collect the trim 200.

It should be noted that the web trim 200 collected in the collection region 56 when the divert bin 50 is operated in the second position will be drawn by gravity into the collection bin 40 when the divert bin 50 is rotated to the first position. Moreover, it is preferable to have a level sensor 110 positioned under the platform 30, as shown in FIG. 4*a,* to monitor the scrap level in the collection bin 40 when the divert bin 50 is operated in the first position for normal trim-collecting operation. When the scrap level reaches a predetermined level, the level sensor turns on the warning light 100 and/or the warning siren 102. However, when the collection bin 40 is filled, it is preferred that the level sensor causes the collection system 10 to shut down.

Figure 5:
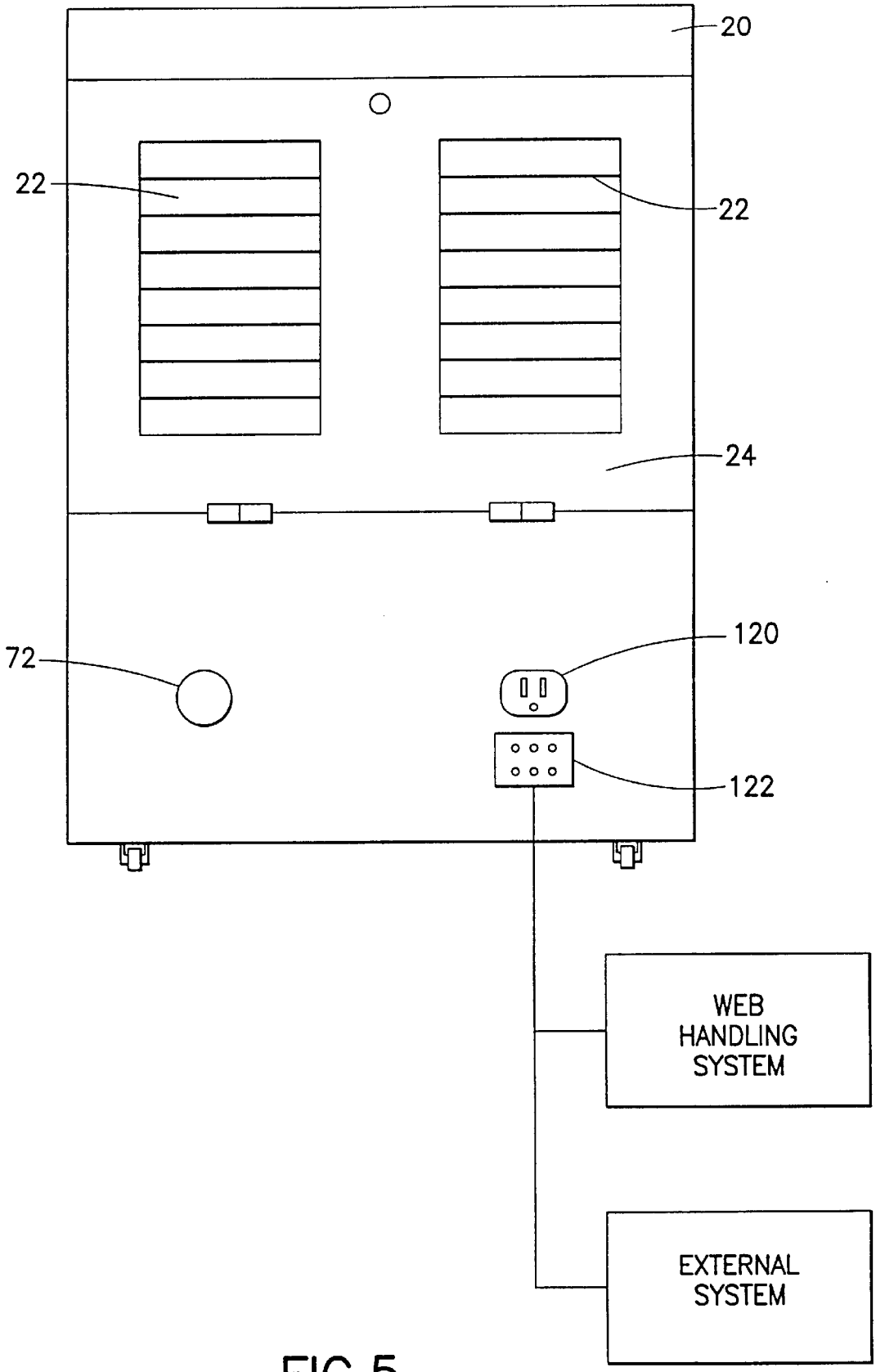
FIG. 5 is a rear view showing the back panel of the web trim collection system, according to the present invention.

FIG. 5 shows the rear panel 20 of the web trim collection system 10. As shown, the rear panel 20 has a door 24, which can be opened when it is necessary to change the air filters 82 behind the air outlets 22. An electrical socket 120 is provided for supplying the power to the collection system 10. Furthermore, an electrical connector 122 is provided as an interface to a web handling system or an external console so that the collection system 10 can be activated locally using the manual control switch 112 or remotely from the web handling system or the external console.

The present invention is disclosed in conjunction with the preferred embodiment thereof. According to the preferred embodiment, a vacuum/motor unit (a forced-air system) is located between the trim receiver and the divert bin to cause the trim to be moved through the divert bin. However, it is also possible to use a vacuum/motor unit located in the filtration chamber to achieve the same. Furthermore, a mechanical system such as a conveyor belt can be used to move the trim from the trim receiver, instead of an air pressure system.

Thus, although the invention has been described with respect to a preferred embodiment thereof, it will be understood by those skilled in the art that the foregoing and various other changes, omissions and deviations in the form and detail thereof may be made without departing from the spirit and scope of this invention.

What is claimed is:

1. A web trim collection system connected to a trim receiver which receives web trim, said system comprising:

a channel having a first end and a second end, the first end communicating with the trim receiver;

a divert bin in communication with the second end of the channel, wherein the divert bin has a means for operating the divert bin between a first position and a second position;

a collection bin communicable with the second end of the channel through the divert bin when the divert bin is operated in a first position so as to allow the web trim to pass through the divert bin and to be deposited into the collection bin, and when the divert bin is operated in the second position, the divert bin interposes between the second end of the channel and the collection bin and collects the web trim, thereby preventing the web trim from being deposited into the collection bin and allowing the collection bin to be removed from said web trim collection system for changeovers of the collection bin while said collection system continues to collect web trim; and a trim moving mechanism for moving the web trim from the trim receiver into the divert bin or further into the collection bin.

2. The web trim collection system of claim 1, wherein when the divert bin is moved from the second position to the first position, the divert bin is so positioned that the web trim collected while in the second position can be deposited into the collection bin.

3. The web collection system of claim 2, wherein the means for operating the divert bin between the first position and the second position includes a pivoting axis on which the divert bin is mounted and a handle attached to the divert bin for rotating the divert bin on the axis.

4. The web collection system of claim 3, wherein the first position of the divert bin is a rotation around the axis whereby the divert bin is substantially upside down, and the second position of the divert bin is a rotation around the axis whereby the divert bin is substantial rightside up while it is interposed between the second end of the channel and the collection bin.

5. The web trim collection system of claim 1, wherein the trim moving mechanism comprises an air pressure system for creating an air flow from the trim receiver through the channel.

6. The web trim collection system of claim 5, wherein the air pressure system comprises one or more blowing fans.

7. The web trim collection system of claim 5, wherein the air pressure system comprises one or more vacuum/motor units.

8. The web trim collection system of claim 5, further comprises one or more air outlets for discharging air brought in by the air flow from the trim collection system into an area surrounding the web trim collection system.

9. The web trim collection system of claim 8, further comprising one or more air filters installed in the one or more air outlets for filtering the air prior to the air being discharged into the surrounding area.

10. The web trim collection system of claim 8, further comprising one or more flapper doors communicable with the one or more air outlets and the collection bin for allowing the air in the collection bin to be discharged from the one or more air outlets through the one or more flapper doors when the divert bin is operated in the first position.

11. The web trim collection system of claim 10, wherein the one or more flapper doors are closed when the divert bin is operated in the second position so as to prevent the air in the collection bin from entering the air outlets.

12. The web trim collection system of claim 1, further comprising a sensing mechanism to sense the level of the web trim deposited in the collection bin when the divert bin is operated in the first position.

13. The web trim collection system of claim 12, further comprising a warning light which is turned on when the sensing mechanism senses that the level of the web trim deposited in the collection bin has reached a predetermined level.

14. The web trim collection system of claim 12, further comprising an audible device which is turned on when the sensing mechanism senses that the level of the web trim deposited in the collection bin has reached a predetermined level.

15. The web trim collection system of claim 12, wherein the sensing mechanism is capable of causing the web trim collection system to shut down when the level of the web trim deposited in the collection bin has reached a predetermined level.

16. The web trim collection system of claim 1, further comprises a control switch for manually turning the web trim collection system on or off.

17. The web trim collection system of claim 1, further comprises an interface to an external console for allowing the external console to turn the web trim collection system on or off in a remote manner.

18. The web trim collection system of claim 1, further comprising a platform having a seal, wherein the platform can be operated in a first platform position in contact with the collection bin so as to provide an air seal to the collection bin with the seal when the divert bin is operated in the first position.

19. The web trim collection system of claim 18, wherein the platform can be operated in a second platform position separating from the collection bin so as to allow the collection bin to be removed from the web trim collection system.

20. The web trim collection system of claim 19, further comprising a sensing mechanism to sense the position of the divert bin so as to prevent the platform from being operated in the second platform position when the divert bin is operated in the first position.

21. The web trim collection system of claim 1, further comprising a control mechanism for manually changing the position of the divert bin.

* * * * *